US007104789B1

(12) United States Patent
Robich et al.

(10) Patent No.: US 7,104,789 B1
(45) Date of Patent: Sep. 12, 2006

(54) WALL STRUCTURE FOR CARBON BAKING FURNACE

(75) Inventors: Thomas N. Robich, Wexford, PA (US); Marc N. Palmisiano, Pittsburgh, PA (US); Thomas R. Kleeb, Allison Park, PA (US)

(73) Assignee: Harbison-Walker Refractories Company, Moon Township, PA (US)

( * ) Notice: Subject to any disclaimer, the term of this patent is extended or adjusted under 35 U.S.C. 154(b) by 0 days.

(21) Appl. No.: 11/083,166

(22) Filed: Mar. 17, 2005

(51) Int. Cl.
*F27B 14/08* (2006.01)

(52) U.S. Cl. ..... 432/248; 432/194; 432/198

(58) Field of Classification Search ..... 432/19, 432/192, 249, 10, 95, 102, 175, 194, 195, 432/198, 238, 248, 264; 52/515
See application file for complete search history.

(56) References Cited

U.S. PATENT DOCUMENTS

| | | | | |
|---|---|---|---|---|
| 3,897,256 | A * | 7/1975 | Murton | 501/129 |
| 4,253,823 | A * | 3/1981 | Holdner | 432/18 |
| 4,256,919 | A * | 3/1981 | Berg | 373/166 |
| 4,469,721 | A * | 9/1984 | Shioya | 427/397.8 |
| 4,504,219 | A * | 3/1985 | Thomas | 432/4 |
| 4,559,998 | A * | 12/1985 | Counterman | 165/109.1 |
| 4,838,208 | A * | 6/1989 | Stubbe et al. | 122/19.2 |
| 5,078,595 | A * | 1/1992 | Roenigk et al. | 432/164 |
| 5,296,288 | A | 3/1994 | Kourtides et al. | 428/262 |
| 5,594,999 | A * | 1/1997 | Best | 34/270 |
| 5,668,072 | A * | 9/1997 | Holcombe et al. | 501/152 |
| 6,007,873 | A * | 12/1999 | Holcombe et al. | 427/376.2 |
| 6,027,339 | A * | 2/2000 | Dreyer et al. | 432/192 |
| 6,793,700 | B1 * | 9/2004 | Pham et al. | 48/198.7 |
| 6,959,757 | B1 * | 11/2005 | Otter | 165/133 |

OTHER PUBLICATIONS

Advertising brochure, Wessex Incorporated, entitled: "EMISSHIELD™, Developed and Refined from NASA Technology"; 6 pages (B-1 to B-6).
Emisshield™ Case Histories and Energy Transfer in Boiler Tubes, Wessex Incorporated, 9 pages.
Products Under Development, Wessex Incorporated, Sep. 2002, 4 pages.
Wessex, Inc., Directing Intellectual Property to Commercialization and Emisshield™ Ceramic/Refractory Products General Information Sheets, 6 pages total.
Publication from: Ceramic Industry, The Exclusive Global Voice of Ceramic Business and Manufacturing, entitled: "Space-Age Refractory Coatings,"BNP Publication, May 2002, 6 pages.

* cited by examiner

*Primary Examiner*—Gregory Wilson
(74) *Attorney, Agent, or Firm*—Kusner & Jaffe

(57) ABSTRACT

A carbon baking furnace having spaced-apart, hollow flue walls defining a soaking pit therebetween. Each of the flue walls is formed of refractory bricks and has a pit face facing the pit and a flue face facing an inner flue gas passage. A coating is provided on the pit face of the flue walls. The coating increases the emissivity value of the pit face, wherein the emissivity value of the pit face is greater than the emissivity value of the flue face.

5 Claims, 3 Drawing Sheets

WALL STRUCTURE FOR CARBON BAKING FURNACE

FIELD OF THE INVENTION

The present invention relates generally to the formation of carbon anodes for smelting of aluminum, and more particularly to a flue wall structure for a carbon baking furnace.

BACKGROUND OF THE INVENTION

One step in the production of aluminum is the smelting of alumina into aluminum metal. The smelting takes place in large, steel, carbon-lined furnaces known as reduction cells. The carbon lining is called a cathode. Alumina is fed into the cells where it is dissolved into molten cryolite (a liquid that can dissolve alumina and conduct electricity at about 970° C.). Carbon block anodes are electrically conductive and are used to introduce electricity into each cell.

The carbon anodes are made in a three-step process. First, petroleum coke and recycled carbon from used anodes are mixed with liquid pitch. This mixture is heated to form a hot paste. The paste is then cooled, and hydraulically pressed or vibrated into a mold to form an anode block. In the second step of the process, the carbon anodes are then "baked" in a carbon baking furnace. This "baking" process helps rid the anodes of impurities and improves their strength and electrical conductivity. Lastly, the carbon anode is then bonded to a metal rod using molten cast iron. This rod allows the anode to be suspended from the reduction cell's super structure during the smelting process.

Perhaps the most important step in forming the carbon anode is the baking process. Precise, uniform heating is necessary to produce a uniform chemical conversion of the raw material to the finished anode block with the desired electrical and physical properties that are required for aluminum smelting. In this respect, the center temperature of the anode is critical and it is important that such temperature be maintained during the heating portion of the "baking" process.

The present invention provides an improved flue wall structure for use in baking carbon anodes in a carbon baking furnace.

SUMMARY OF THE INVENTION

In accordance with a preferred embodiment of the present invention, there is provided a carbon baking furnace having spaced-apart, hollow flue walls defining a soaking pit therebetween. Each of the flue walls is formed of refractory bricks and has a pit face facing the pit and a flue face facing an inner flue gas passage. A coating is provided on the pit face of the flue walls. The coating increases the emissivity value of the pit face, wherein the emissivity value of the pit face is greater than the emissivity value of the flue face.

In accordance with another aspect of the present invention, there is provided a flue wall in a carbon baking furnace having a soaking pit for soaking carbon blocks. The flue wall is formed of refractory brick and has a flue face and a pit face. The flue face is in communication with hot combustion gases for heating the flue wall and the pit face is in communication with the soaking pit for conveying heat from the combustion gases to the soaking pit. The pit face of the flue wall is coated with a material that increases the emissive properties of said pit face at elevated temperatures.

In accordance with another aspect of the present invention, there is provided a flue wall having an inner surface defining an inner chamber to be heated by a burner and an outer surface for heating an area adjacent the outer surface. An outer surface coating is provided on the outer surface of the flue wall. The outer surface coating increases the emissivity of the outer surface. An inner surface coating is provided on portions of the inner surface. The inner surface coating increases the emissivity of the portions of the inner surface.

In accordance with yet another aspect of the present invention, there is provided a heat exchanger, comprised of an inner surface to be heated by radiative heat and convective heat, and an outer surface for heating an area adjacent the outer surface. An outer surface coating is provided on the outer surface. The outer surface coating increases the emissivity of the outer surface. An inner surface coating is provided on portions of the inner surface that are primarily heated by radiative heat. The inner surface coating increases the emissivity of the coated portions of the inner surface.

An advantage of the present invention is a flue wall in a carbon baking furnace that provides more efficient heating of anode blocks within the carbon baking furnace.

Another advantage of the present invention is a flue wall as described above that reduces the likelihood of significant heat variations along the surface of the flue wall.

Another advantage of the present invention is a heat exchanger that provides more efficient heat transfer from a burner on one side of the heat exchanger to the other side of the heat exchanger.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
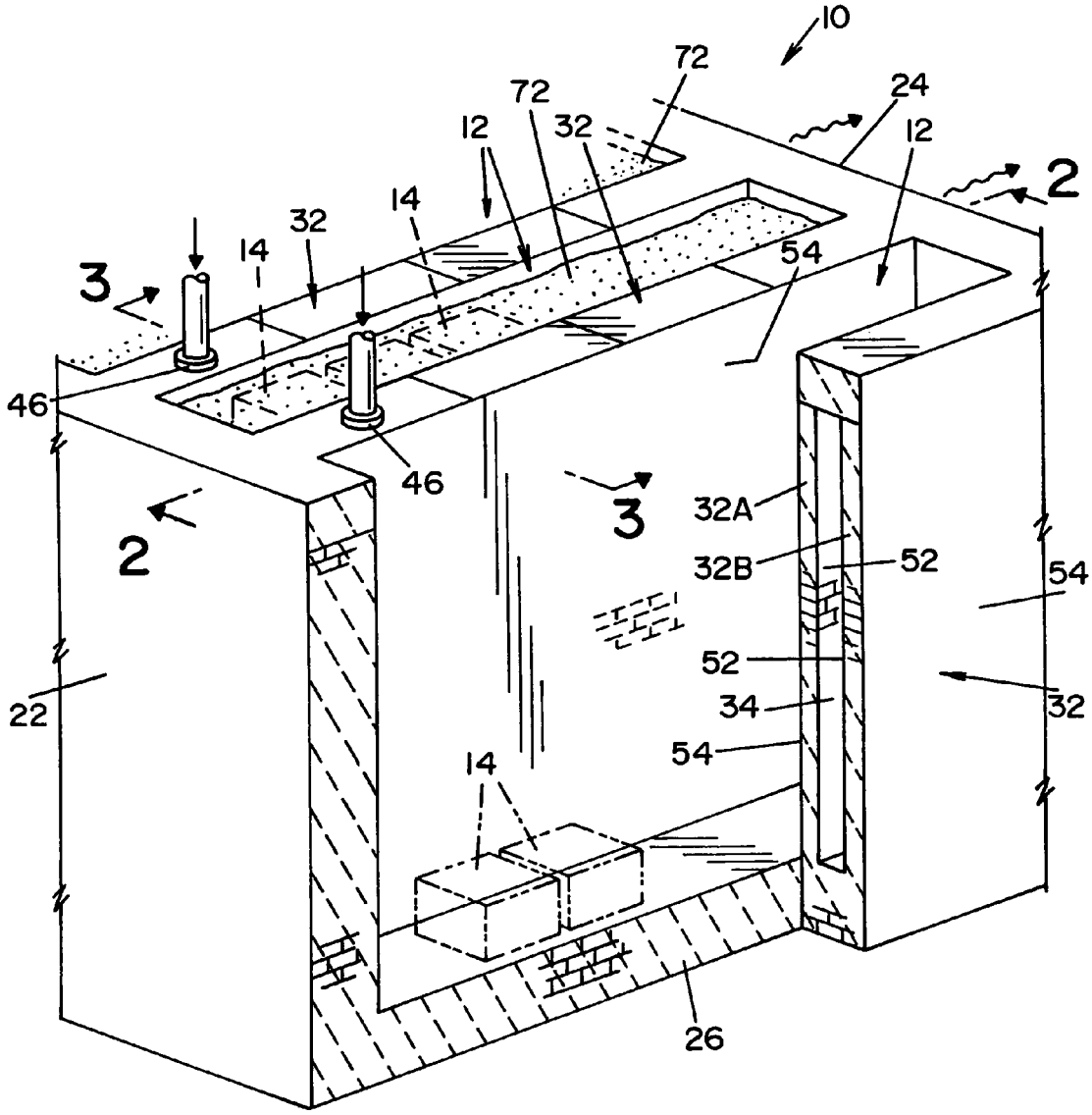
FIG. 1 is a partially-sectioned, perspective view of a flue wall in a carbon baking furnace.

Referring now to the drawings wherein the showings are for the purpose of illustrating a preferred embodiment of the invention only, and not for the purpose of limiting same, FIG. 1 is a perspective view of a portion of a typical carbon baking furnace 10. Carbon baking furnace 10 includes a plurality of narrow, rectangular pits 12, where a plurality of carbon blocks, shown in phantom lines in the drawings and designated 14, are stacked one upon another. Each pit 12 is basically defined by two end walls 22, 24 and a bottom wall 26 and two spaced-apart flue walls 32. End walls 22, 24, bottom wall 26 and flue walls 32 are formed of refractory bricks and refractory shapes, as pictorially illustrated in the drawings.

Figure 2:
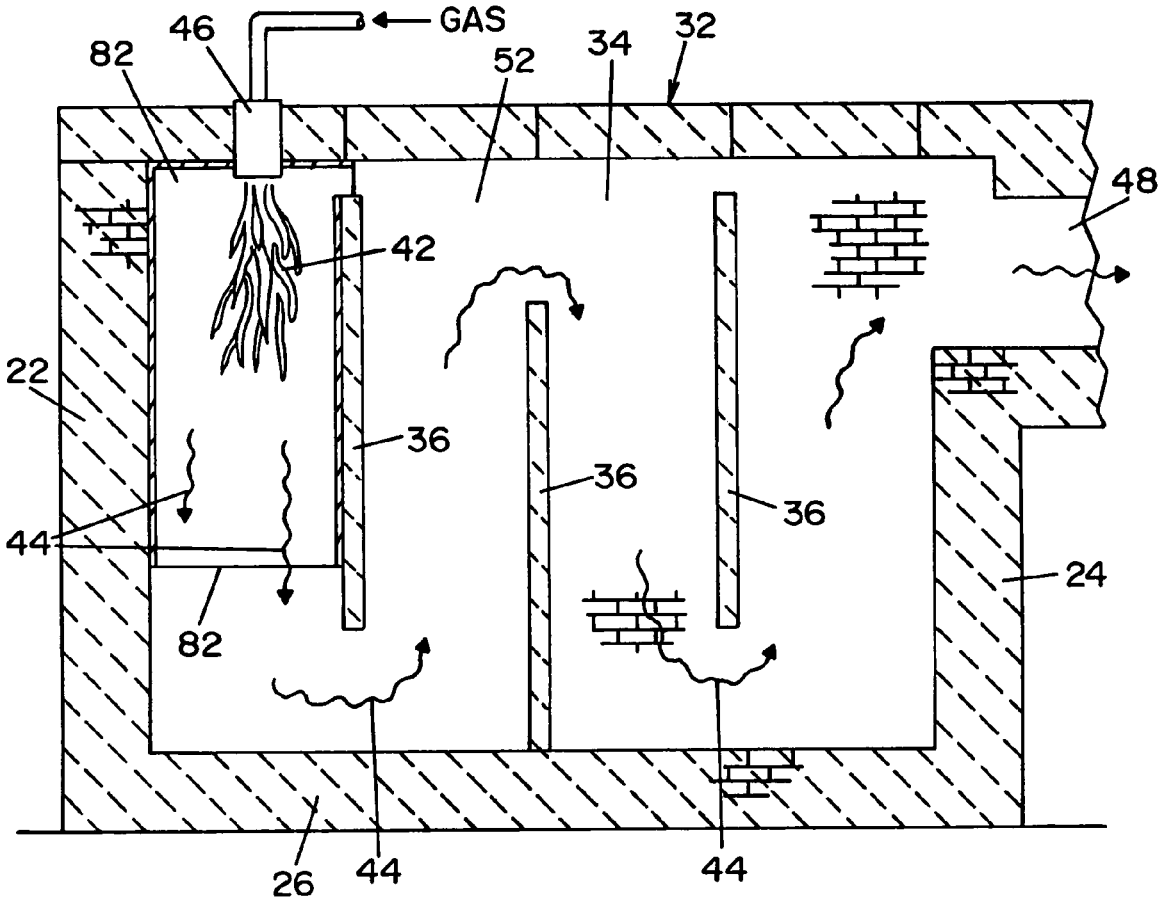
FIG. 2 is a sectional view taken along lines 2—2 of FIG. 1.

Each flue wall 32 is essentially a hollow structure defining an inner space or cavity 34 (best seen in FIG. 2). Baffles 36 are disposed within cavity 34 in flue wall 32 at locations to define a serpentine path or passageway through flue wall 32, as illustrated in FIG. 2. A flame 42 and hot combustion gases 44 are directed into flue wall 32 from a burner 46, as is conventionally known. In the embodiment shown, a burner 46 directs a flame 42 and hot combustion gases 44 flow into each flue wall 32 through the upper end of flue wall 32, as best seen in FIG. 2. Hot combustion gas 44 follows the serpentine path through flue wall 32 to an exit port 48 formed in end wall 24.

Flue wall 32 includes two spaced-apart, upright flue wall sections 32A, 32B. Each wall section 32A, 32B includes flue face 52 that faces toward internal cavity 34 and a pit face 54 that faces pit 12 (see FIG. 1).

In one embodiment of the present invention, a coating 62 is applied to pit face 54 of each flue wall section 32A, 32B. Coating 62 is a high emissivity coating that increases the emissivity of pit face 54 at elevated temperatures, e.g., in the range of 800° C. to 1200° C. In this embodiment, flue face 52 is not coated with a high emissivity coating 62. As a result, the emissivity value of a pit face 54 of a flue wall section 32A, 32B is higher than the emissivity value of flue face 52, at the baking temperature of carbon baking furnace 10.

Coating 62 may be comprised of any commercially available high emissivity coatings that will increase the emissivity of pit face 54 at the operating temperatures of baking furnace 10. By way of example, and not limitation, coating 62 may be comprised of one of several types of high emissivity coatings sold by Wessex Incorporated of Blacksburg, Va., under the registered trademark EMISSHIELD®.

Coating 62 may be applied to the surface of individual refractory bricks that form pit face 54 of flue wall 32. Preferably, coating 62 is applied per manufacturer's instructions, on pit face 54 or flue wall 32 between baking operations.

Figure 3:
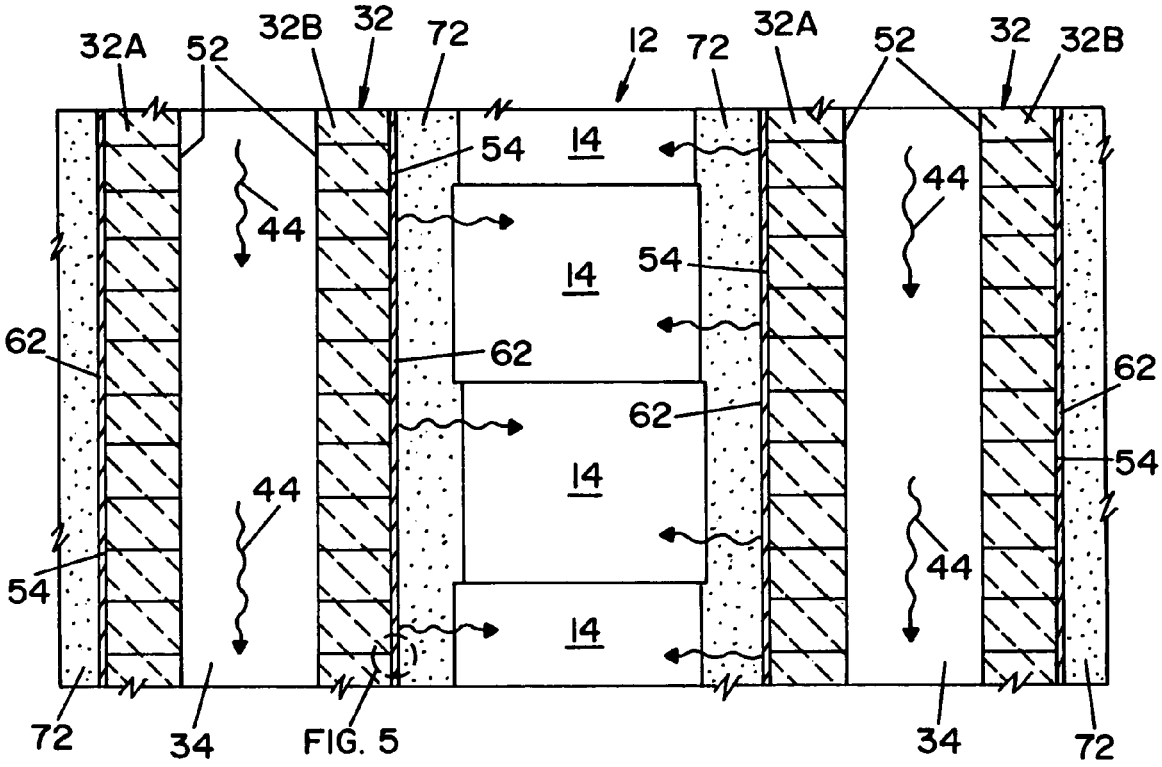
FIG. 3 is a sectional view taken along lines 3—3 of FIG. 1.

Referring now to the operation and use of the present invention, carbon anodes 14 are stacked within pit 12 of furnace 10. Anodes 14 are stacked one upon another to generally form a wall of anode blocks in the center of pit 12, as generally illustrated in FIG. 3. A space exists on both sides of the anode block wall between the surface of the anode blocks and the facing pit surfaces of the opposing flue walls 32. This space or gap is filled with loose carbon material, designated 72 in the drawings.

Figure 4:
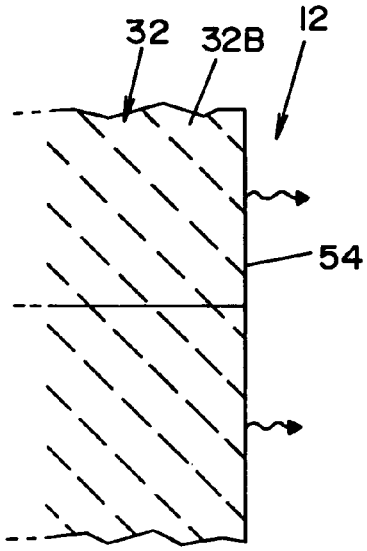
FIG. 4 is an enlarged pictorial view of a surface of the flue wall without an emissitively-increasing coating, schematically illustrating heat radiating off the pit face of the flue wall.
Figure 5:
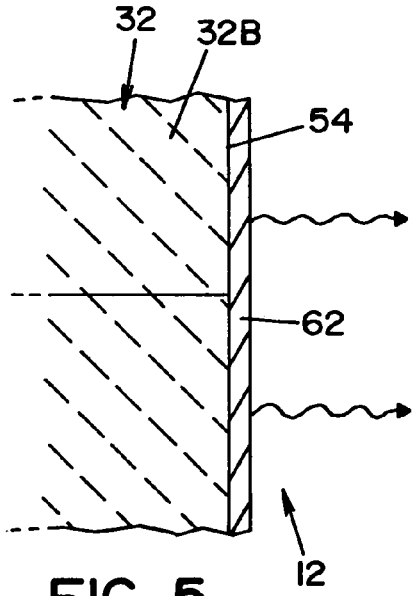
FIG. 5 is an enlarged pictorial view of a surface of the flue wall with an emissitively-increasing coating, schematically illustrating heat radiating off the pit face of the flue wall.

In a conventionally known manner, hot combustion gases 44 are forced into cavity or space 34 within flue wall 32. As illustrated in FIG. 2, combustion gases 44 flow in a serpentine path around baffles 36 within cavity 34 and exit the flue wall through exit port 48. Combustion gases 44 within flue wall 32 heat the refractory bricks forming flue wall sections 32A, 32B. As pictorially illustrated in FIGS. 3–5, the heat is conducted through the refractory brick of flue wall sections 32A, 32B into pit 12. More specifically, the heat radiates from pit face 54 into pit 12. Carbon powder 72 within pit 12 helps conduct the heat of flue wall 32 to carbon anodes 14. Coating 62 on pit face 54 facilitates the emission of heat from pit face 54 into pit 12. In this respect, all surfaces emit thermal radiation. However, at a given temperature and wavelength, there is a maximum amount of radiation that any surface can emit. Surfaces with high emissivity values can emit thermal radiation more rapidly than surfaces with low emissivity values. By coating pit face 54 with a coating 62 having a high emissivity value at the operating temperature of furnace 10, the ability of pit face 54 of flue wall 32 to radiate heat into pit 12 is increased. Moreover, the ability to radiate heat more rapidly from the surface of flue wall 32 provides a more uniform heating surface along pit face 54. For example, the temperature of combustion gases 44 may vary along the serpentine path through flue walls 32. Moreover, corners of cavity 34 may have temperatures lower than other areas within cavity 34. By increasing the emissivity of pit face 54, variations in temperature across pit face 54 can be reduced. The present invention thus provides a flue wall structure having more efficient heat transfer to pit 12 in a carbon baking furnace 10.

It is also believed that emissive coatings, such as the aforementioned EMISSHIELD® coating, may improve the alkali resistance of flue wall 32 of carbon baking furnace 10, thereby prolonging the useful life of furnace 10 by preventing penetration of alkali, as well as other impurities given off by the anodes during the baking process, into the refractory brick forming flue wall 32. In addition, it is further believed that coating 62 on pit face 54 will reduce the adherence of carbon powder 72 onto pit face 54 during each soaking cycle.

In another embodiment of the present invention, in addition to applying coating 62 to pit face 54, coating 62 is applied to select area(s) 82 of flue face 52. Specifically, coating 62 is applied to area(s) 82 of flue face 52 where radiative heating is the primary mechanism (mode) for heating flue face 52. Coating 62 is not applied to areas of flue face 52 where convective heating is the primary mechanism for heating flue face 52.

More specifically, burner 46 produces flame 42 within cavity 34 of flue wall 32. Flame 42 will extend from burner 46 into a cavity of a certain length. Area(s) 82 of flue face 52 around or near flame 42, the primary mechanism of heat transfer is radiative heating. Radiative heating is the result of electromagnetic radiation, i.e., light waves (photons) hitting flue face 52 of flue wall 32. It is believed that having high emissivity coating 62 on area(s) 82 of flue face 52 where radiative heating is the principal mechanism of heating will cause flue wall 32 to absorb heat more rapidly and to heat up faster, since absorbability and emissivity are the same thing.

Further along the serpentine passage through flue wall 32, radiation heating is not the primary mode for heating flue wall 32. In this area, convection heating heats flue wall 32. Convection heating is the result of the transfer of energy by molecular interaction between the molecules of the heated gases 44 within flue wall 32 interacting with molecules along flue face 52. In these areas, high-emissivity coating 62 would not be applied to flue face 52 because coating 62 would cause flue wall 32 to heat more slowly because flue surface 52 would radiate away, i.e., into cavity 34, from heat absorbed by flue wall 32 through convection.

By providing coating 62 only on those area(s) 82 of flue face 52 where radiative heating is the primary mechanism for heating, flue wall 32 is heated more rapidly. The thermal energy absorbed by flue wall 32 is then radiated into pit 12 by pit surface 54.

In summary, by providing coating 62 along pit surface 54 and along those area(s) 82 of flue surface 52 where radiative heating is the primary mechanism for heating flue wall 32, a more efficient structure for radiating thermal energy from cavity 34 within flue wall 32 to pit 12 is provided.

The foregoing description is a specific embodiment of the present invention. It should be appreciated that this embodiment is described for purposes of illustration only, and that numerous alterations and modifications may be practiced by those skilled in the art without departing from the spirit and scope of the invention. For example, the present invention finds advantageous application in any flue wall having an inner surface defining an inner chamber to be heated by a burner and an outer surface for heating an area adjacent the outer surface. In this respect, the outer surface would be coated with a material increasing the emissivity of the outer surface at elevated temperatures. Portions of the inner surface of the flue wall would be coated with a material increasing the emissivity of those portions of the inner surface at elevated temperatures. The portion(s) of the inner surface of the flue wall to be coated with the material are those areas that are primarily heated by radiation heating of the burner or source of combustion. Similarly, the present invention includes a heat exchanger having an inner surface to be heated by radiative heat and convective heat, and an outer surface for heating an area adjacent the outer surface. An outer surface coating would be applied to the outer surface of the heat exchanger to increase the emissivity of the outer surface at elevated temperatures. An inner surface coating would be applied on those portions of the inner surface of the heat exchanger that are heated primarily by radiative heat. The inner surface coating would increase the emissivity of those portions at elevated temperatures. It is intended that all such modifications and alterations be included insofar as they come within the scope of the invention as claimed or the equivalents thereof.

Having described the invention, the following is claimed:

1. In a carbon baking furnace having spaced-apart, hollow flue walls defining a soaking pit therebetween, each of said flue walls being formed of refractory bricks and having a pit face facing said pit and a flue face facing an inner flue gas passage, the improvement comprising:

a first coating on said pit face of said flue walls, said coating increasing the emissivity value of said pit face, wherein the emissivity value of said pit face is greater than the emissivity value of said flue face; and a second coating on a portion of said flue face of said flue walls, said second coating being formed of the same material as said first coating, wherein said portion of said flue face having said second coating is that portion of said flue face that is primarily heated by radiative heating.

2. A flue wall in a carbon baking furnace having a soaking pit for soaking carbon blocks, said flue wall being formed of refractory brick and having a flue face and a pit face, said flue face being in communication with hot combustion gases for heating said flue wall and said pit face being in communication with said soaking pit for conveying heat from said combustion gases to said soaking pit, said pit face of said flue wall being coated with a material that increases the emissivity properties of said pit face at elevated temperatures for facilitating the transfer of heat to said soaking pit and a portion of said flue face of said flue wall being heated primarily by radiative heating, wherein said portion of said flue face that is heated primarily by radiative heating is coated with the same material on said pit face of said flue wall.

3. In a flue wall having an inner surface defining an inner chamber to be heated by a burner, said flue wall having an outer surface for heating an area adjacent said outer surface, the improvement comprising:

an outer surface coating on said outer surface of said flue wall, said outer surface coating increasing the emissivity of said outer surface; and an inner surface coating on portions of said inner surface, said inner surface coating increasing the emissivity of said portions of said inner surface wherein said portions of said inner surface of said flue wall having said inner surface coating are primarily those portions of said inner surface that are heated by said burner by radiative heating.

4. A flue wall as defined by claim 3, wherein said outer surface coating is the same as said inner surface coating.

5. A flue wall as defined in claim 3, wherein said inner surface coating and said outer surface coating increases the emissivity of the flue wall at elevated temperatures.

* * * * *